United States Patent [19]

Metz

[11] Patent Number: 4,875,402

[45] Date of Patent: Oct. 24, 1989

[54] RECOIL BRAKE FOR A GUN HAVING A HEAT EQUALIZATION AND INDICATION DEVICE

[75] Inventor: Josef Metz, Neuss, Fed. Rep. of Germany

[73] Assignee: Rheinmetall GmbH, Düsseldorf, Fed. Rep. of Germany

[21] Appl. No.: 231,007

[22] Filed: Aug. 11, 1988

[30] Foreign Application Priority Data

Aug. 27, 1987 [DE] Fed. Rep. of Germany ..... 3728532

[51] Int. Cl.[4] ..... F41F 19/02; F16F 9/10

[52] U.S. Cl. ..... 89/43.01; 89/42.01

[58] Field of Search ..... 89/43.01, 42.01; 188/312-317

[56] References Cited

U.S. PATENT DOCUMENTS

| | | | |
|---|---|---|---|
| 1,841,969 | 1/1932 | Methlin | 89/43.01 |
| 3,410,174 | 11/1968 | Hahn | 89/43.01 |
| 3,745,880 | 7/1973 | Metz et al. | 89/43.01 |
| 4,485,722 | 12/1984 | Metz et al. | 89/43.01 |
| 4,587,882 | 5/1986 | Metz | 89/43.01 |
| 4,729,280 | 3/1988 | Metz et al. | 89/43.01 |

FOREIGN PATENT DOCUMENTS

| | | |
|---|---|---|
| 220370 | 5/1987 | European Pat. Off. . |
| 1283706 | 8/1969 | Fed. Rep. of Germany . |

*Primary Examiner*—David H. Brown

*Attorney, Agent, or Firm*—Spencer & Frank

[57] ABSTRACT

A recoil brake for a gun includes a brake cylinder in which a piston is slidably arranged. As the piston moves when urged by the recoiling mass, it displaces fluid through a narrow flow cross section to thus brake the recoiling mass. The piston rod and the brake cylinder define a brake chamber formed therebetween. The recoil brake is provided with a heat equalization device that includes a heat equalization chamber which is bounded by a spring-tensioned heat equalization piston. An indicator element is coupled to the heat equalization piston for detecting an operating condition (the temperature of the hydraulic fluid) of the recoil brake. The heat equalization and indication device is a self-contained, modular unit releasably connected to a rearward end of the brake cylinder and forming an axial extension thereof. The heat equalization and indication device further has an impact plate bounding the heat equalization chamber and the brake chamber.

5 Claims, 1 Drawing Sheet

RECOIL BRAKE FOR A GUN HAVING A HEAT EQUALIZATION AND INDICATION DEVICE

BACKGROUND OF THE INVENTION

The present invention relates to a recoil brake for a gun. The recoil brake includes a brake cylinder in which a piston is slidably arranged. As the piston moves when urged by the recoiling mass, it displaces fluid through a narrow flow cross section to thus brake the recoiling mass. The piston rod and the brake cylinder define a brake chamber formed therebetween. The recoil brake is provided with a heat equalization device that includes a heat equalization chamber therein which may receive hydraulic fluid from the brake chamber through a throttle bore. The heat equalization chamber is bounded by a spring-tensioned heat equalization piston which is coupled with an indicator element for detecting an operating condition (the temperature of the hydraulic fluid) of the recoil brake.

A recoil brake of the above type is disclosed in German Pat. No. 1,283,706 which describes a recoil brake containing a heat equalization chamber disposed in the nonpressurized front region of the recoil brake and is connected with the pressure equalizing chamber that cooperates with the brake chamber. Since the connected indicator device which indicates the operational state of the brake is thus disposed at the front of the recoil brake, it is difficult to observe the operational state of the recoil brake with simple means within the interior of a turret (for example, the turret of an armored howitzer).

Published European Patent Application No. 220,370 discloses a heat equalization device provided apart from the recoil brake. The heat equalization device is coupled by additional conduits to the nonpressurized rear region of the recoil brake. While this arrangement allows the heat equalization device to be easily seen from the interior of the turret, it involves additional expenses and the risk of leakages.

SUMMARY OF THE INVENTION

It is an object of the present invention to provide an improved recoil brake of the above-discussed type which has a heat equalization and indication device of simple construction and a rearward disposition that allows an operating condition (temperature of the hydraulic fluid) of the brake to be easily monitored.

This object and others to become apparent as the specification progresses, are accomplished by the invention, according to which, briefly stated, the recoil brake includes a brake cylinder in which a piston is slidably arranged. As the piston moves when urged by the recoiling mass, it displaces fluid through a narrow flow cross section to thus brake the recoiling mass. The piston rod and the brake cylinder define a brake chamber formed therebetween. The recoil brake is provided with a heat equalization device that includes a heat equalization chamber which is bounded by a spring-tensioned heat equalization piston. An indicator element is coupled to the heat equalization piston for detecting an operating condition (the temperature of the hydraulic fluid) of the recoil brake. The heat equalization and indication device is a self-contained, modular unit releasably connected to a rearward end of the brake cylinder and forming an axial extension thereof. The heat equalization and indication device further has an impact plate bounding the heat equalization chamber and the brake chamber. The impact plate has a throttle passage for maintaining communication between the brake chamber and the heat equalization chamber. The indicator element is located in the heat equalization device so that it can extend therefrom toward the breechblock of the gun thereby allowing an easy determination of the temperature of the hydraulic fluid in the recoil brake.

By configuring the heat equalization and indication device as a modular unit which is attachable to the recoil brake, a simple installation is ensured. The indication of the operating condition (the temperature of the hydraulic fluid) can be easily made in the interior of the turret since the indicator does not protrude from the turret opening. The position of the heat equalization piston indicates the fluid level in the heat equalization chamber dependent upon the temperature of the hydraulic fluid in the recoil brake. It is also feasible to indicate the fluid level by a display device which is situated in the crew pit remote from the gun cradle and which is connected with the heat equalization device by appropriate signal transmitting means.

DESCRIPTION OF THE PREFERRED EMBODIMENT

Figure 1:
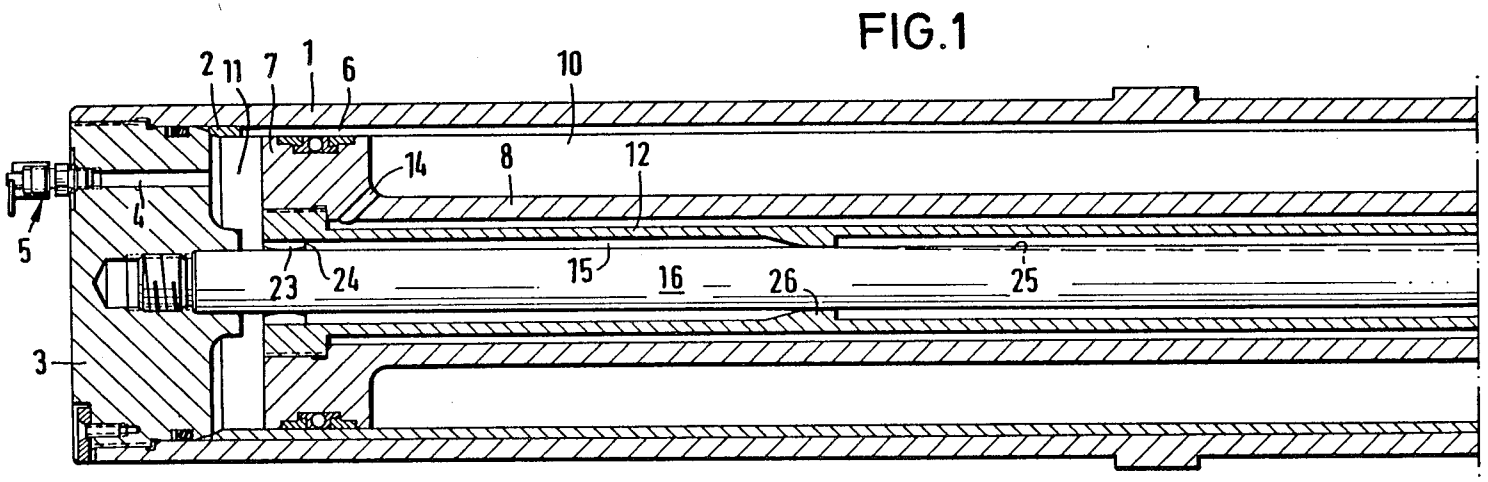
FIGS. 1 and 2 are axial sectional views of a preferred embodiment of the invention, showing first and second length portions of the same construction.
Figure 2:
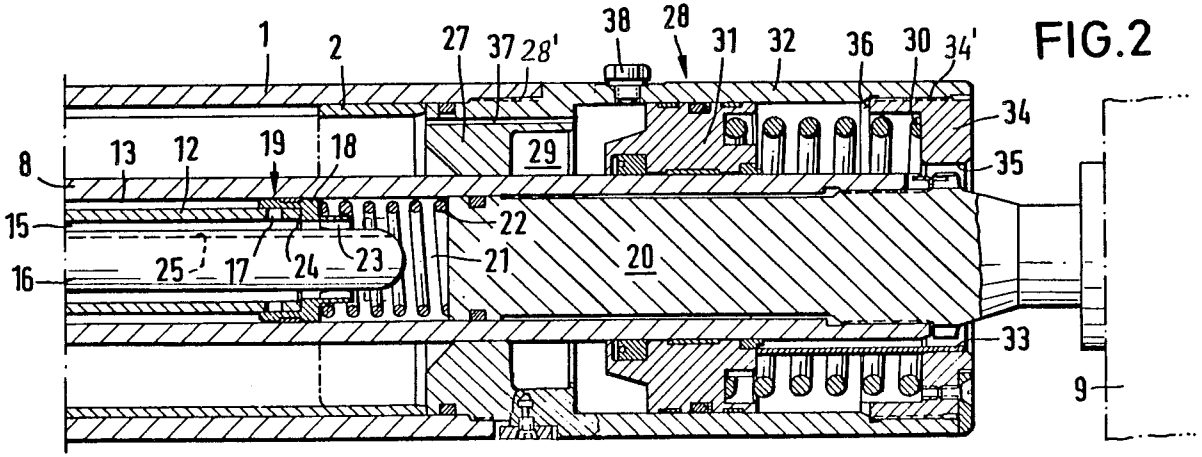

Turning to the two Figures which, when viewed together end-to-end, show the entire single elongated construction, there is illustrated a brake cylinder 1 having a control sleeve 2 that has been inserted so that it lies against the inner wall of the brake cylinder 1. The brake cylinder 1 is closed at its front end by a cap nut 3 that is screwed into the front end. The cap nut 3 is provided with a bore 4 which is closed by an oil filling valve 5. The front of the control sleeve 2 contacts and is supported by the cap nut 3. The control sleeve 2 is provided with at least one axial control groove 6 extending substantially over its entire length. A piston 7 is slidably disposed within the control sleeve 2 and has a hollow piston rod 8. Between the piston rod 8 and the control sleeve 2 a brake chamber 10 is defined which communicates through the control groove 6 with an equalizing chamber 11 disposed between the cap nut 3 and the piston 7.

A throttle sleeve 12 extends over almost the entire stroke length of the piston rod 8. The end of throttle sleeve 12 is threadedly fastened to the front of the piston 7. Between the piston rod 8 and the throttle sleeve 12 there is formed an annular inlet channel 13 which communicates with the brake chamber 10 by means of openings 14 disposed in the region of the piston 7. A buffer spear 16, screwed into the cap nut 3 and having a rounded free end, is disposed axially in throttle sleeve 12 so as to form an annular outlet channel 15 therewith. That end of the throttle sleeve 12 which is oriented toward the breechblock 9 is provided with bores 17 in a circumferential series. This end of the throttle sleeve 12 also supports an annular valve body 18 of a check valve 19 which, in the illustrated starting position of the recoil brake, seals the bores 17 on the exterior side of the throttle sleeve 12.

A coupling member 20 is threadedly inserted into the end of the piston rod 8 remote from the piston 7 for connecting the piston rod 8 with the breechblock 9 of the gun. The coupling member 20 bounds a buffer spear chamber 21 which is constituted within the interior of piston rod 8 by the free space between the free end of the throttle sleeve 12 and connecting member 20. The buffer spear chamber 21 is sealed toward the inlet channel 13 by the valve body 18. The valve body 18 is urged against the free end of throttle sleeve 12 by means of a spring 22 that is supported at the end face of the coupling member 20. The front (cradle-side) end of the throttle sleeve 12 in the region of the piston 7 and the valve body 18 are both provided with substantially hemispherical slide bushing or sleeve guides for the buffer spear 16. The slide bushing guides 24 are interrupted by axial passages 23 which allow fluid to pass through the slide bushing guides 24.

The buffer spear 16 is provided with a throttle groove 25 that extends from the free end of the buffer spear 16 over a substantial part—preferably between ⅔ and 4/5—of its length. An annular guide bushing 26 is formed on the throttle sleeve 12 and, together with a momentarily aligned portion of the throttle groove 25, constitutes a constricted passage for the fluid flowing between the throttle sleeve 12 and the buffer spear 16. The throttle groove 25 is configured to have a continuously decreasing cross section viewed from its end which is oriented towards the free end of the buffer spear 16. The position of the guide 26 on throttle sleeve 12 and the course of the throttle groove 25 determines the length of the counter recoil path. If the recoil brake is in the position of rest, the end of the throttle groove 25 stops short of the guide bushing 26.

As the gun is fired, the piston rod 8 is retracted by the breechblock 9 thereby increasing the fluid pressure in brake chamber 10. This causes most of the hydraulic fluid of the brake chamber 10 to flow into an equalizing chamber 11 through the control groove 6 in the control sleeve 2, thus causing steady braking of the recoiling mass of the gun.

As the gun is recoiling, another part of the hydraulic fluid of brake chamber 10 flows through the openings 14 in piston 7 into and through the inlet channel 13 which is between the piston rod 8 and the throttle sleeve 12. From throttle sleeve 12, the fluid forces open the check valve 19 by overcoming the force of spring 22 and flows through the bores 17 into the buffer spear chamber 21. Because of the brake pressure on the hydraulic fluid, the hydraulic fluid fills the buffer spear chamber 21 quickly and completely during recoil.

At the end of the recoil, a recuperator (not shown) pulls the recoiling mass back toward the front (counterrecoil movement), returning it to the firing position. In the firing position, the buffer spear 16 projects into the buffer spear chamber 21 (as shown). During the counterrecoil movement, the hydraulic fluid located in the equalizing chamber 11 flows through the control groove 6 back into the brake chamber 10. As this occurs, the hydraulic fluid in the buffer spear chamber 21 flows back to the equalizing chamber 11 only through a constriction in the buffer spear 16. This constriction is formed by the throttle guide 26 of the throttle sleeve 12 and the throttle groove 25 and is configured so that it is matched to the function of the weapon. Once this fluid has returned to the equalizing chamber 11, it is returned to the brake chamber 10 as described above. This allows a defined counterrecoil braking to be effected independent of the magnitude of the propelling charge employed during firing.

According to the invention, to the rear terminus of the brake cylinder 1, adjacent the breechblock 9, there is secured a heat equalization and indication device generally designated at 28. The device 28 is essentially a self-contained modular unit which comprises a cylindrical housing 32 having an impact disc or plate 27 at one end and a closure disc 34 at the axial opposite end. The impact disc 37 may be a one-piece, integral member with the cylindrical housing 32 whereas the closure disc 34 may be attached to the housing 32 by means of a threaded connection 34'. The heat equalization and indication device 28 is attached to the brake cylinder 1 by means of a threaded connection 28' such that the device 28 is in an axial alignment with the brake cylinder 1 and thus constitutes an axial prolongation of the brake cylinder 1 in the rearward direction, that is, towards the breechblock 9 of the gun.

The impact plate 27 takes up the braking forces during firing and transfers them to the brake cylinder 1 and also serves to support one end of the control sleeve 2. The heat equalization and indication device 28 also includes a heat equalizing chamber 29 on the side of the impact plate 27 which faces away from brake chamber 10 and is bounded at the other end by a heat equalization piston 31 slidably arranged in the housing 32. The heat equalization piston 31 is normally urged in the direction of the impact plate 27 by a coil spring 30 countersupported by the closure disc 34. The heat equalization piston 31 is sealed against the piston rod 8 which extends through the heat equalization and indication device 28 and against the inner wall of the cylindrical housing 32. The heat equalization piston 31 also functions as a sliding guide for the piston rod 8 passing therethrough.

The heat equalization piston 31 is equipped with an indicator element 33 which moves out of the housing 32 upon a predetermined displacement of the heat equalization piston 31. The closure 34 is provided with a passage opening 35 for the piston rod 8, the connecting member 20, and the indicator element 33, respectively. The closure 34 also includes an abutment 36 which acts as a rear stop for the heat equalization piston 31. The heat equalizing chamber 29 communicates with the brake chamber 10 by a throttle bore 37 which extends through the impact plate 27. The throttle bore 37 is coordinated with the braking function of the recoil brake and prevents the brake pressure from passing into the heat equalization chamber 29 with full force. The tolerances between the piston rod 8 and the impact plate 27 also prevent the brake pressure from passing into the heat equalization chamber 29 with full force. Thus, dependent on the temperature of the hydraulic fluid, the position of the heat equalization piston 31—which equalizes volume changes of the hydraulic fluid in the range of operating temperatures —shows, by means of the indicator element 33, the level of volume and the temperature of the hydraulic fluid in the recoil brake.

A ventilation screw 38 is provided in the housing 32 in the region of the heat equalization chamber 29 to allow air to be removed from the recoil brake when it is filled with hydraulic fluid.

It will be understood that the above description of the present invention is susceptible to various modifications, changes and adaptations, and the same are intended to be comprehended within the meaning and range of equivalents of the appended claims.

What is claimed is:

1. In a recoil brake for a gun, including a brake cylinder adapted to be filled with hydraulic fluid and having opposite first and second ends;

a piston slidably received in the brake cylinder; said piston separating an inner volume of said brake cylinder into a brake chamber and an equalizing chamber;

a piston rod affixed to said piston and extending axially through said brake chamber towards said second end and being arranged for connection to a breechblock of the gun at said second end;

a first throttle passage maintaining hydraulic communication between said brake chamber and said equalizing chamber for effecting a throttled flow of hydraulic fluid therebetween upon movement of the piston; and a heat equalization and indication device having a heat equalization chamber; means defining a second throttle passage maintaining hydraulic communication between said brake chamber and said heat equalization chamber; a heat equalization piston slidably disposed in said heat equalization chamber and being exposed to a pressure of hydraulic fluid situated in the heat equalization chamber and a spring connected to the great equalization piston for urging said heat equalization piston into said heat equalization chamber; and an indicator element coupled with said heat equalization piston;

the improvement wherein said heat equalization and indication device is a self-contained, modular unit releasably connected to said second end of said brake cylinder and forming an axial extension thereof; said heat equalization and indication device further comprising an impact plate bounding said heat equalization chamber in said heat equalization device and said brake chamber in said brake cylinder; said second throttle passage being provided in said impact plate.

2. A recoil brake as defined in claim 1 wherein said heat equalization and indication device is connected to said brake cylinder by a threaded connection.

3. A recoil brake as defined in claim 1, wherein said indicator element is movably disposed in said heat equalization and indication device adjacent to said heat equalization piston, said indicator element being adapted to project from an end of said unit in an axial direction away from said brake cylinder.

4. A recoil brake as defined in claim 1, wherein said piston rod passes through and is slidingly contacted and guided by said heat equalization piston.

5. A recoil brake as defined in claim 4, wherein said second throttle passage is dimensioned so that it prevents transmission of high braking pressures from said brake chamber to said heat equalization chamber.

* * * * *